US006463683B2

(12) United States Patent
Skwarchuk

(10) Patent No.: US 6,463,683 B2
(45) Date of Patent: Oct. 15, 2002

(54) END GATE FOR GRADER BLADE

(76) Inventor: Kenneth Michael Skwarchuk, 4520-46A Street, Alberta Beach, Alberta (CA), T0E 0A6

( * ) Notice: Subject to any disclaimer, the term of this patent is extended or adjusted under 35 U.S.C. 154(b) by 0 days.

(21) Appl. No.: 09/751,876

(22) Filed: Dec. 28, 2000

(65) Prior Publication Data

US 2002/0043385 A1 Apr. 18, 2002

(30) Foreign Application Priority Data

Oct. 18, 2000 (CA) ..... 2323972

(51) Int. Cl.[7] ..... E01H 5/06
(52) U.S. Cl. ..... 37/280; 37/274
(58) Field of Search ..... 37/266, 270, 274, 37/272, 273, 275, 276, 280, 281; 172/684.5, 784

(56) References Cited

U.S. PATENT DOCUMENTS

| | | | | | |
|---|---|---|---|---|---|
| 3,055,126 | A | * | 9/1962 | Emhof | 37/280 |
| 3,208,166 | A | * | 9/1965 | Proulx | 37/280 |
| 3,231,991 | A | * | 2/1966 | Wandscheer et al. | 37/280 |
| 3,279,104 | A | * | 10/1966 | Wandscheer et al. | 37/280 |
| 4,077,139 | A | | 3/1978 | Fagervold et al. | 37/41 |
| 4,217,707 | A | * | 8/1980 | Karlsson | 37/280 |
| 4,707,936 | A | * | 11/1987 | Steinhoff | 37/264 |
| 5,890,546 | A | | 4/1999 | Kerpash, Sr. | 172/684.5 |
| 5,894,689 | A | | 4/1999 | Turk | 37/281 |
| 5,903,986 | A | | 5/1999 | Parker | 37/281 |
| 5,921,326 | A | | 7/1999 | Ragule | 172/815 |
| 6,240,660 | B1 | * | 6/2001 | Dugas | 37/280 |
| 6,249,992 | B1 | * | 6/2001 | Irving et al. | 37/281 |

FOREIGN PATENT DOCUMENTS

| | | | |
|---|---|---|---|
| CA | 1040854 | 10/1978 | E02F/3/76 |

OTHER PUBLICATIONS

IMAC Techno Focus, Snow Removal Products brochure, vol. 2, Feb. 1996, 4 pages.
Weldco–Beales Mfg. Inc., Motor Grader Attachments brochure, printed 1999, 4 pages.
Weldco–Beales, Moldboard End Gates product information, dated prior to Dec. 2, 1999, 4 pages.
Fer–Marc Equipment Ltd., Sno–Rid product information, Dec. 2, 1999, 4 pages.
Briggs Machine & Fabrication, Inc., American Grader Gate price list and product information, Dec. 18, 2000, 2 pages.
H–Series Motor Graders Appliaction Guide, p. 37, Moldboard Wing Gate product information, dated prior to Dec. 2000.
Weldco–Beales Mfg. Inc. Product Catalog, May 1, 2000, 4 pages.
IMAC, Moldboard Endgate Installation Guide, 1 page, dated prior to Jan. 17, 2001.
IMAC, Attachment Price List, 3 pages, Jun. 15, 2000.

* cited by examiner

*Primary Examiner*—Thomas B. Will
*Assistant Examiner*—Meredith C. Petravick
(74) *Attorney, Agent, or Firm*—Davis & Bujold, P.L.L.C.

(57) ABSTRACT

An end gate for a grader blade includes a first body attachable to a grader blade. A second body is provided which supports a barrier member. The second body is pivotally secured to the first body for movement between a lowered operative position and a raised transport position. Upon the barrier member sustaining an impact when in the lowered operative position, the second body pivots to the raised transport position thereby reducing damage to the barrier member resulting from the impact.

8 Claims, 4 Drawing Sheets

END GATE FOR GRADER BLADE

FIELD OF THE INVENTION

The present invention relates to an end gate for a grader blade and, in particular, a grader blade used in moving snow.

BACKGROUND OF THE INVENTION

Graders are commonly used for snow removal. One problem that exists is snow migrating along the grader blade and escaping from a remote end of the grader blade. This results in the grader operator having to go over an area being cleared of snow twice. The first time to remove the majority of the snow. The second time to pick up any surplus snow that escaped from the remote end of the grader blade.

In order to address this problem end gates were developed for grader blades. The end gates block the remote end of the grader blade to prevent snow from escaping. There is currently one major drawback to using an end gate on a grader blade. As the end gate is positioned at the remote end of the grader blade it is frequently striking the curb, chunks of frozen ice and other hazards along the roadside that may not be visible to the grader operator when there is an accumulation of snow. The useful life of an end gate for a grader blade is short, as they tend to wear rapidly as a result of all of the impacts to which they are subjected.

SUMMARY OF THE INVENTION

What is required is an end gate for a grader blade which will not be as susceptible to damage upon impact.

According to the present invention there is provided an end gate for a grader blade which includes a first body attachable to a grader blade. A second body is provided which supports a barrier member. The second body is pivotally secured to the first body for movement between a lowered operative position and a raised transport position. Upon the barrier member sustaining an impact when in the lowered operative position, the second body pivots to the raised transport position thereby reducing damage to the barrier member resulting from the impact.

Whereas in the past the end gates were tied in a fixed position and, as such, sustained substantial damage upon impact; the end gate, as described above, simply moves to the raised transport position upon impact. This minimizes the damage the barrier member sustains.

Although beneficial results may be obtained through the use of the end gate for a grader blade, as described above, it is preferred that end gate float over minor obstacles and ground deformations while remaining in the lowered operative position. Even more beneficial results may, therefore, be obtained when the second body is biased into the lowered operative position. This can be done in several ways. For example, the weight of the second body can bias the second body into the lowered operative position by force of gravity or a spring can be utilized to bias the second body into the lowered operative position. Spring biasing is preferred.

Although beneficial results may be obtained through the use of the end gate for a grader blade, as described above, it is expected that the barrier member will periodically sustain an impact. Even more beneficial results may, therefore, be obtained when a leading edge of the barrier member has an impact foot. The impact foot is intended to receive an impact, thereby saving the barrier member from damaging. It is preferred that the impact foot has an inclined plane surface which will initiate movement of the second body to the raised transport position upon impact.

Although beneficial results may be obtained through the use of the end gate for a grader blade, as defined above, the grader operator will not always want to leave the end gate floating in the lowered operative position. There will be times when he will want to place the end gate in the raised transport position so he can drive to or from an assigned work area. Even more beneficial results may be obtained when means are provided to selectively lock the second body in the raised transport position.

Although beneficial results may be obtained through the use of the end gate for a grader blade, as defined above, the grader operator will not always want to leave the end gate floating in the lowered operative position when working. If the grader operator is clearing a paved parking lot with no ground obstacles, he will want the end gate to be fixed rather than floating, so he can do a better job. When the end gate floats, it periodically lets snow escape everytime it raises. Even more beneficial results may, therefore, be obtained when a connection with a sheer pin is provided to selectively lock the second body in the lowered operative position. This holds the end gate in a fixed position, however, upon the barrier member sustaining an impact when in the lowered operative position the sheer pin sheers enabling the second body to pivot to the raised transport position thereby reducing damage to the barrier member resulting from the impact.

Although beneficial results may be obtained through the use of the end gate for a grader blade, as described above, the grader operator will not want to climb down from the heated cab of his grader on cold winter days to move the end gate between the raised transport position and the lowered operative position. Even more beneficial results may, therefore be obtained when a telescopic actuator is provided having a first end and a second end. A first connection connects the first end of the telescopic actuator to the first body. A second connection connects the second end of the telescopic actuator to the second body. Through use of the telescopic actuator, the grader operator is able to selectively move the second body between the lowered operative position and the raised transport position. In order to do this either the first connection or the second connection must include a sheer pin. Upon the barrier member sustaining an impact when in the lowered operative position the sheer pin sheers. The sheering of the sheer pin disconnects the telescopic actuator and enables the second body to pivot to the raised transport position thereby reducing damage to the barrier member and the telescopic actuator resulting from the impact.

Although beneficial results may be obtained through the use of the end gate for a grader blade, as described above, the preferred configuration of biasing spring and telescopic actuator has a spring which overlies the telescopic actuator. The spring remains fully connected and functional upon the sheer pin being sheered to bias the second body into the lowered operative position.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
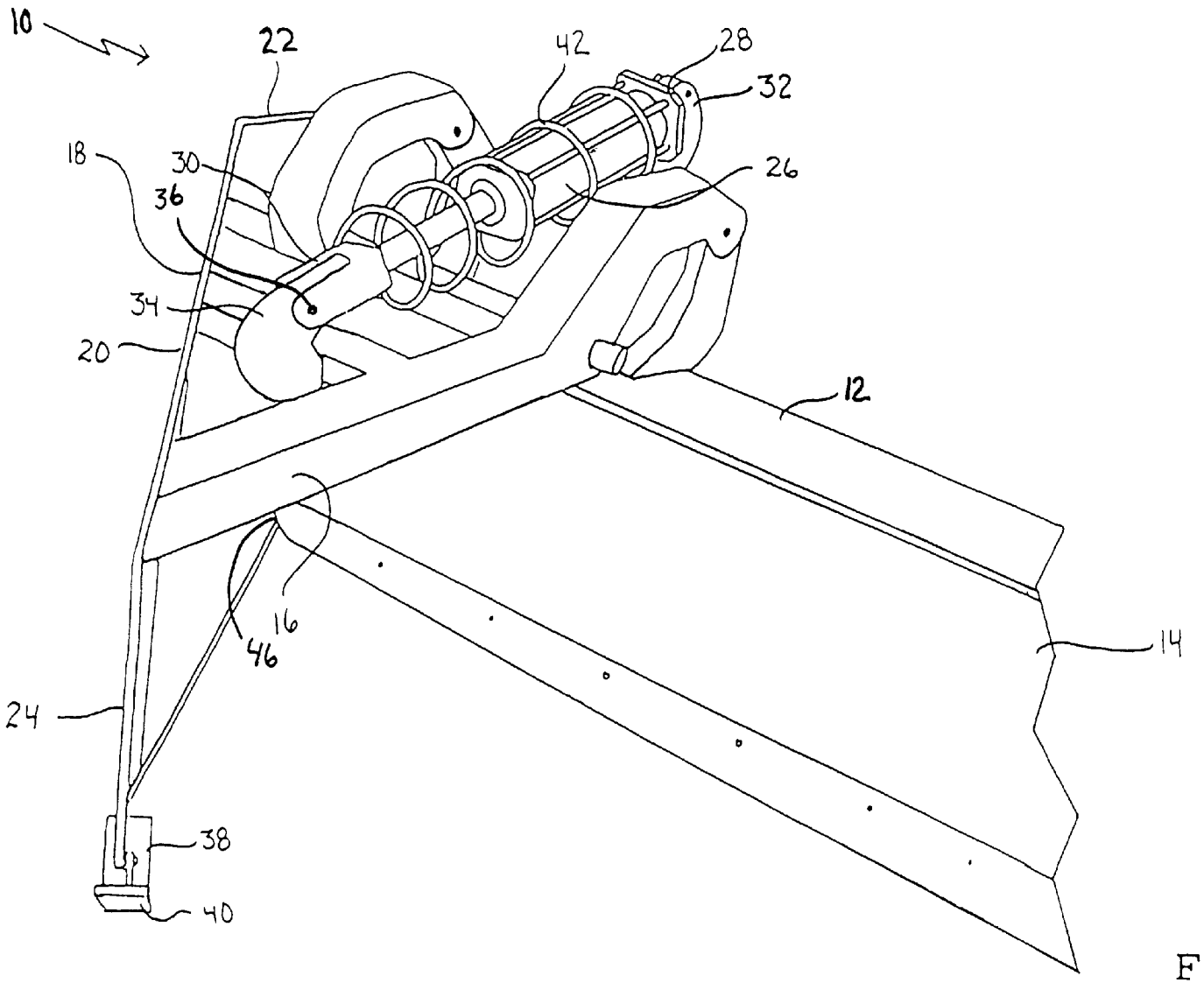
FIG. 1 is front perspective view of an end gate for a grader blade constructed according to the teachings of the present invention, with the end gate in a lowered operative position.

The preferred embodiment, an end gate for a grader blade generally identified by reference numeral 10, will now be described with reference to FIGS. 1 through 4.

Structure and Relationship of Parts

Figure 2:
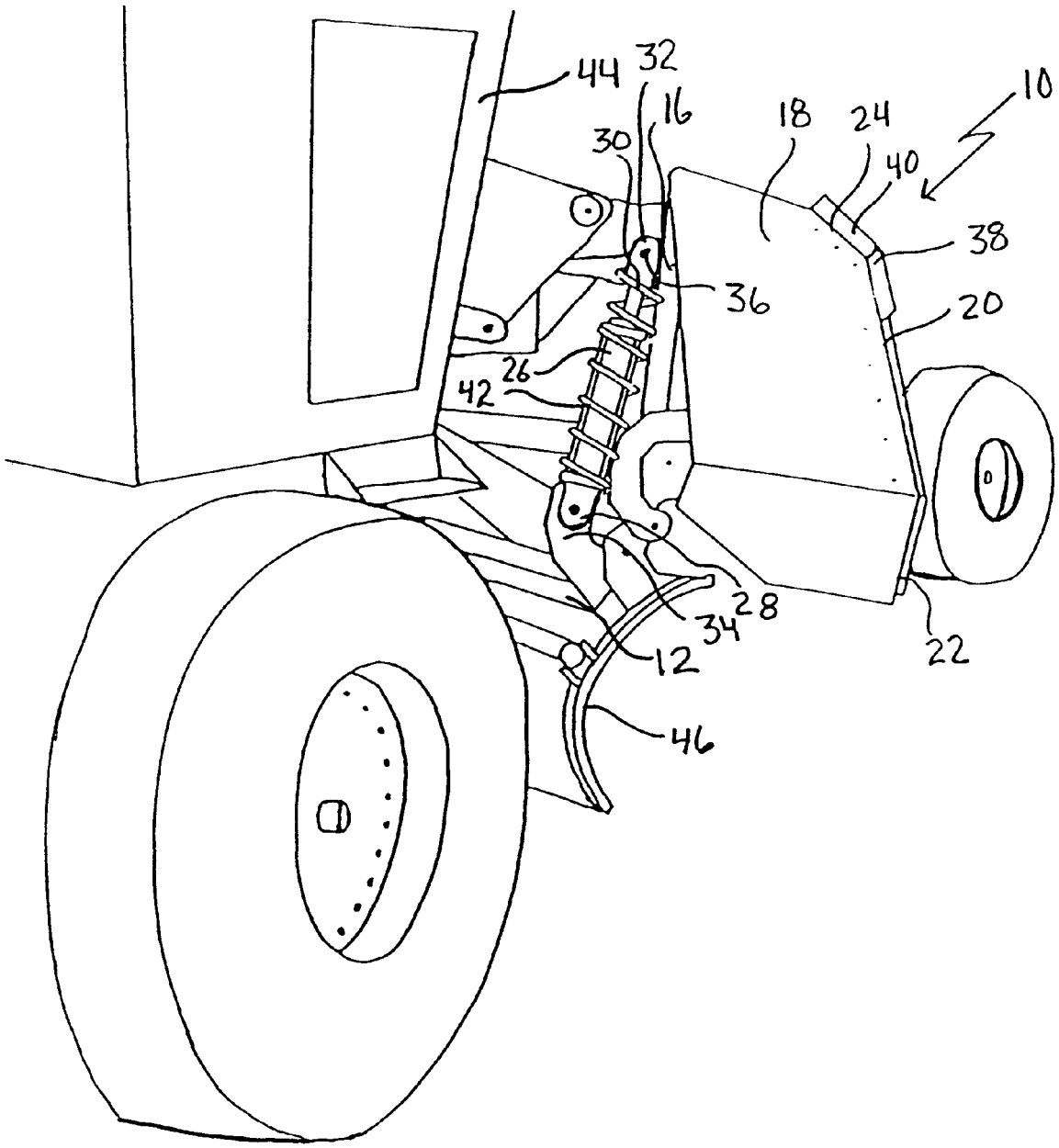
FIG. 2 is a rear perspective view of the end gate for a grader blade illustrated in FIG. 1, with the end gate in a raised transport position.

Referring to FIG. 1, there is provided an end gate 10 for a grader blade, that has a first body 12 attached to a grader blade 14, and a second body 16 that supports a barrier member 18. Barrier member 18 consists of a dogleg plate body 20 having a trailing edge 22 and a leading edge 24. Second body 16 is pivotally secured to first body 12 for movement between a lowered operative position as illustrated in FIG. 1 and a raised transport position as illustrated in FIG. 2.

Figure 3:
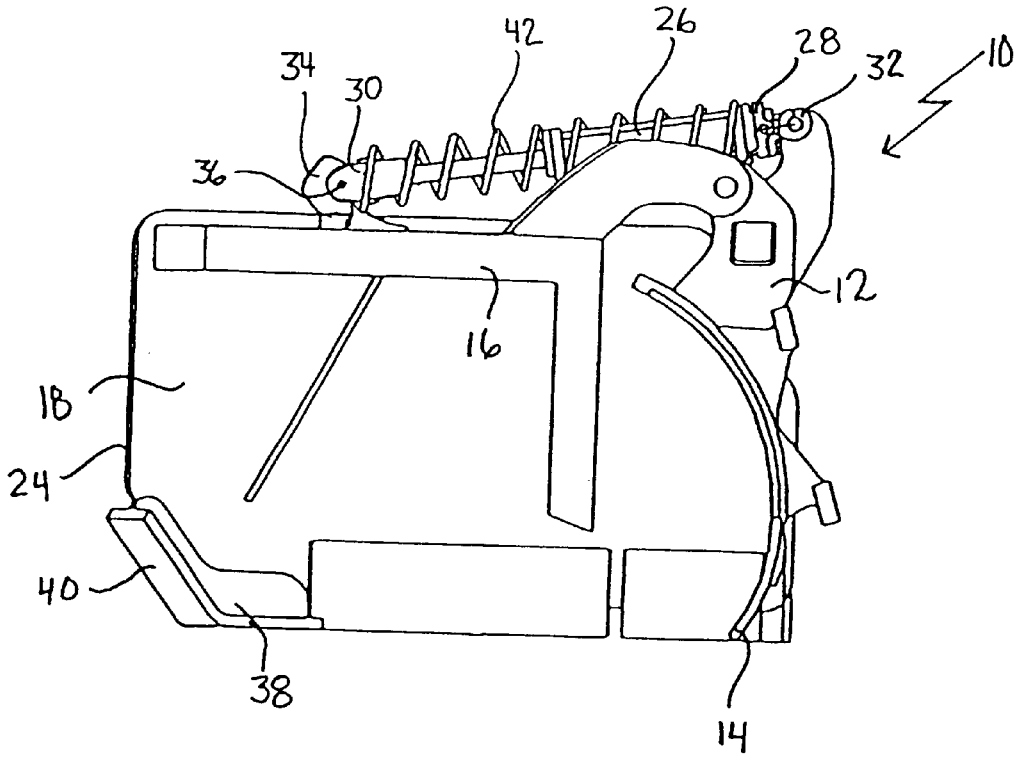
FIG. 3 is side elevation view of the end gate for a grader blade illustrated in FIG. 1, with the end gate in a lowered operative position.
Figure 4:
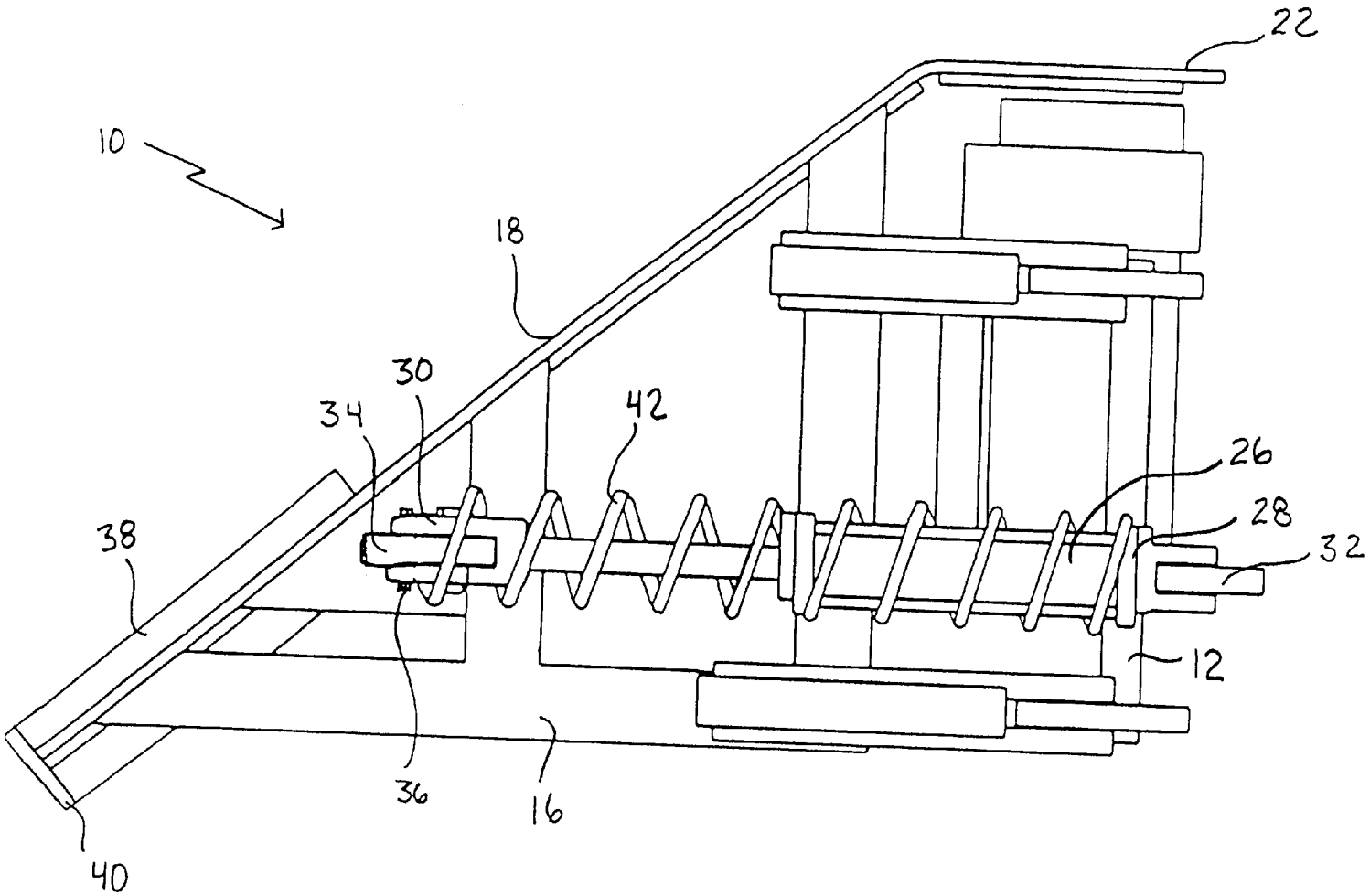
FIG. 4 is a top plan view of the end gate for a grader blade illustrated in FIG. 1.

Referring to FIG. 4, a telescopic actuator 26 is provided in the form of an hydraulic cylinder. Telescopic actuator 26 has a first end 28 and a second end 30. Referring to FIG. 3, a first connection 32 connects first end 28 of telescopic actuator 26 to first body 12 and a second connection 34 connects second end 30 of telescopic actuator 26 to second body 16 so that telescopic actuator 26 can selectively move second body 16 between the lowered operative position and the raised transport position. Second connection 34 has a sheer pin 36, so that upon barrier member 18 sustaining an impact when in the lowered operative position, sheer pin 36 sheers and disconnects telescopic actuator 26 and enables second body 16 to pivot to the raised transport position thereby reducing damage to barrier member 18 and telescopic actuator 26 which may result from an impact.

An impact foot 38 with an inclined plane surface 40 is positioned on leading edge 24 of barrier member 18. An impact upon impact foot 38 initiates movement of second body 16 to the raised transport position upon impact.

Second body 16 is biased into the lowered operative position by a spring 42 which overlies telescopic actuator 26 and remains fully connected and functional upon sheer pin 36 being sheered.

Operation

The use and operation of an end gate 10 for a grader blade 14 will now be described with reference to FIGS. 1 through 4. Referring to FIG. 2, end gate 10 is pivotally attached to a grader 44 in such a manner that when the operator of grader 44 transports grader 44 to a desired location, barrier member 18 and second body 16 can be secured in the raised transport position. When in the raised transport position, barrier member 18 is spaced from a remote end 46 of grader blade 14.

Referring to FIG. 1, upon arrival at the desired location, second body 16 and barrier member 18 are lowered into the operative position. When in the operative position, body 20 of barrier member 18 extends at an angle in front of remote end 46 of grader blade 14 and trailing edge 22 of barrier member 18 lies transversely across thereby blocking remote end 46 of grader blade 14 so as to prevent snow gathered by grader blade 14 from escaping at remote end 46.

When movement of barrier member 18 relative to the surface area being cleared is desired so that barrier member 18 will float over minor obstacles and ground deformities, the operator removes shear pin 36. Spring 42 which overlies telescopic actuator 26 biases second body 16 into the lowered operative position. Even without spring 42, the weight of second body 16 will serve to bias second body 16 into the lowered operative position by force of gravity. Spring 42 is preferred as it prevents second body 16 jumping up to the transport position every time there is an impact when working on uneven ground. As grader 44 moves along a snow covered surface, grader blade 14 will collect snow from the surface. Snow is prevented from escaping from remote end 46 of grader blade 14 by barrier member 18 at remote end 46 of grader blade 14.

In the event that the location being cleared is a smooth area such as a parking lot with no ground obstacles, the operator may prefer barrier member 18 to be in a fixed position rather than floating. This is because as barrier member 18 floats, barrier member 18 periodically lets snow escape when it raises. To secure barrier member 18 in a fixed position, the operator inserts sheer pin 36 through second connection 34 that connects second end 30 of telescopic actuator 26 to second body 16. When in the fixed position, barrier member 18 will no longer float but will maintain its position relative to the surface area being cleared. Should the barrier member 18 sustain an impact by striking a curb or an ice chunk while fixed in the lowered operative position, the resulting impact upon impact foot 38 positioned along leading edge 24 of barrier member 18, initiates the pivotal upward movement of second body 16 into the raised transport position. Sheer pin 36 will sheer upon impact thereby disconnecting telescopic actuator 26 from second body 16 and allowing the movement to the raised transport position without resistance from telescopic actuator 26. Once the operator has cleared the obstacle from the path of grader 44, the operator can return barrier member 18 to the lowered operative position, and insert new sheer pin 36 in second connection 34 and then proceed to clear the remaining area. If the operator does not have a new sheer pin, he can rely upon the biasing force of spring 42 to bias second body 16 into the lowered operative position.

After clearing snow from the desired area, barrier member 18 and second body 16 can be raised by telescopic actuator 26 to the raised transport position while grader 44 is transported to another locale for either storage or additional clearing.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. An end gate for a grader blade, comprising:

a first body attachable to a grader blade;

a second body supporting a barrier member, the second body being pivotally secured to the first body for movement between a lowered operative position and a raised transport position;

a telescopic actuator having a first end and a second end, a first connection connecting the first end of the telescopic actuator to the first body and a second connection connecting the second end of the telescopic actuator to the second body, whereby the telescopic actuator selectively moves the second body between the lowered operative position and the raised transport position; and at least one of the first connection and the second connection connecting the telescopic actuator to one of the first body and the second body solely by a sheer pin, such that upon the barrier member sustaining an impact when in the lowered operative position the sheer pin sheers and disconnects the telescopic actuator and enables the second body to pivot to the raised transport position thereby reducing damage to the barrier member and the telescopic actuator resulting from the impact.

2. The end gate for a grader blade as defined in claim 1, where the telescopic actuator is a hydraulic cylinder.

3. The end gate for a grader blade as defined in claim 1, wherein the second body is biased into the lowered operative position by a spring which overlies the telescopic actuator and remains fully connected and functional upon the sheer pin being sheered.

4. The end gate for a grader blade as defined in claim 1, wherein a leading edge of the barrier member has an impact foot with an inclined plane surface, thereby initiating movement of the second body to the raised transport position upon impact.

5. An end gate for a grader blade, comprising:

a first body attachable to a grader blade;

a second body supporting a barrier member, the second body being pivotally secured to the first body for movement between a lowered operative position and a raised transport position;

a telescopic actuator in the form of a hydraulic cylinder, the telescopic actuator having a first end and a second end, a first connection connecting the first end of the telescopic actuator to the second body, whereby the telescopic actuator selectively moves the second body between the lowered operative position and the raised transport position; and at least one of the first connection and the second connection connecting the telescopic actuator to one of the first body and the second body solely by a sheer pin, such that upon the barrier member sustaining an impact when in the lowered operative position the sheer pin sheers and disconnects the telescopic actuator and enables the second body to pivot to the raised transport position thereby reducing damage to the barrier member and the telescopic actuator resulting from the inpact;

a leading edge of the barrier member having an impact foot with an inclined plane surface, thereby initiating movement of the second body to the raised transport position upon impact;

the second body being biased into the lowered operative position by a spring which overlies the telescopic actuator and remains fully connected and functional upon the sheer pin being sheered.

6. An end gate for a grader blade, comprising in combination:

a grader blade having a remote end;

a first body attachable to the remote end of the grader blade;

a second body supporting a barrier member, the barrier member having a leading edge and a trailing edge, the second body being pivotally secured to the first body for movement between a lowered operative position in which the trailing edge of the barrier member lies transversely across and blocks the remote end of the grader blade, and a raised transport position in which the barrier member is spaced from the remote end of the grader blade;

a telescopic actuator having a first end and a second end, a first connection connecting the first end of the telescopic actuator to the first body and a second connection connecting the second end of the telescopic actuator to the second body, whereby the telescopic actuator selectively moves the second body between the lowered operative position and the raised transport position; and at least one of the first connection and the second connection connecting the telescopic actuator to one of the first body and the second body solely by a sheer pin, such that upon the barrier member sustaining an impact when in the lowered operative position the sheer pin sheers and disconnects the telescopic actuator and enables the second body to pivot to the raised transport position thereby reducing damage to the barrier member and the telescopic actuator resulting from the impact.

7. The end gate for a grader blade as defined in claim 6, wherein the leading edge of the barrier member extends at an angle in front of the remote end of the grader blade.

8. The end gate for a grader blade as defined in claim 6, wherein the leading edge of the barrier member extends at an angle in front of the remote end of the grader blade.

* * * * *